United States Patent [19]

Greenwald, Sr. et al.

[11] 4,323,281

[45] Apr. 6, 1982

[54] METHOD OF SURFACE MINING

[75] Inventors: Edward H. Greenwald, Sr., McMurray; Edward H. Greenwald, Jr.; Frederick R. Bonci, both of Pittsburgh, all of Pa.

[73] Assignee: Eavenson, Auchmuty & Greenwald, Coraopolis, Pa.

[21] Appl. No.: 122,394

[22] Filed: Feb. 19, 1980

[51] Int. Cl.[3] ..... E21C 41/00

[52] U.S. Cl. ..... 299/1; 299/19; 405/303; 434/151; 434/299

[58] Field of Search ..... 299/1, 19; 434/150–153, 299; 405/258, 303

[56] References Cited

U.S. PATENT DOCUMENTS

| | | | |
|---|---|---|---|
| 3,751,827 | 8/1973 | Gaskin | 434/151 |
| 4,150,852 | 4/1979 | McCoy | 299/19 |
| 4,150,853 | 4/1979 | McCoy | 299/19 |

*Primary Examiner*—Ernest R. Purser

*Attorney, Agent, or Firm*—Thomas H. Murray; Clifford A. Poff

[57] ABSTRACT

A method of developing, mining and restoring a mining property having one or more mineral bearing rock seams is provided. Three-dimensional topographic control data, mineral bearing rock seam location data, water flow data, and overburden stratification and constituency data are collected and a topographic map of the mine property is prepared. An access road is located on the map to the mineral bearing rock seams and various environmental control facilities, topsoil storage areas and overburden disposal sites are identified and located on the map. Next, the mining operations are broken into sequential phases and placed on the topographic map. Mining of the seam material is then accomplished by sequential phases. After completing the first phase, each succeeding sequential phase is completed. During each succeeding sequential phase, a portion of the mine property in the preceeding phase is preferably restored. Finally, after all sequential phases are complete, the remaining portions of the mine property are restored and the area revegetated.

11 Claims, 8 Drawing Figures

METHOD OF SURFACE MINING

BACKGROUND OF THE INVENTION

This invention relates to a method of surface mining which develops a sequential phase plan, recovers the desired material from the mineral bearing rock seam and restores the mine property according to federal and state environmental and mining laws.

The first laws and regulations to control surface mining of coal were adopted as early as the 1940s. Since then, regulations have been promulgated on a continuous basis and in the direction of increasing the control of the regulatory bodies over the surface coal mining industry. Without exception, each amendment has imposed more stringent permit and operating procedures. Coupled with economic demands imposed by market conditions, the operator has had to employ more sophisticated planning techniques to optimize return on investment and comply with all health, safety and environmental regulations.

Prior to passage of control legislation, operating a surface mine in, for example, a coal seam above drainage involved following the coal outcrop and removing the overburden to the limits dictated by the economics of the project. Timber, surface soil and rock (spoil) were often disposed of by pushing downhill or over the mining bench into previously undisturbed forest and drainage areas. As much overburden was moved as was economical relative to the amount of coal to be recovered. The amount of coal or other minerals that could be removed was largely determined by the operator's ability to keep production costs to a minimum and thus compete in the marketplace.

Operating costs, as well as market conditions and market value, control the surface mining industry today. However, the methods of mining have changed considerably due to the adoption of environmental laws and regulations. Permit systems have been developed in several states wherein the enforcement authority for the adopted rules and regulations has been vested in a specific department of state governments. The permit applications generally call for the operator to answer questions and submit data concerning the method by which he intends to mine. However, filing permit applications does not vouch for the economic soundness of the project or in any manner require the operator to have a premining plan worked out prior to commencement of mining. As of the present, permit applications do not require the complete planning and scheduling of mining operations prior to commencement of operations.

Passage of the Federal Surface Mining and Reclamation Control Act of 1977 has imposed such demands on the industry that preplanning is essential to controlling environmental and economic concerns. In the past, no one particular method has been devised which adequately deals with the development of a surface mining project and integrates the project elements of mining technology, mining progression, project economics, environmental planning, management, supervision and permit application. No method is compatible with all of these major elements of surface mine development.

Heretofore technical planning has not dealt with integrating environmental considerations into the mine plan. In addition, plans have never been prepared in such a format as to be easily read and understood by both nontechnical management and technical personnel. Previously, this information was not compatible with mining permit applications because the agencies did not require this data. No other method provides universal coordination of all steps necessary to plan and develop surface mining.

OBJECTS OF THE INVENTION

An object of the invention is to provide, in topographical illustration, a method for developing, mining and restoring a mining property. The illustrations represent a complete visual presentation of the integration of planning, environmental and economic considerations required for development of a surface mine. It is a further objective to provide information used to operate the mine returning the property to contours similar to its undisturbed state.

SUMMARY OF THE INVENTION

In accordance with the present invention, a method of developing, mining and restoring property having at least one mineral bearing rock seam is provided which comprises collecting three-dimensional topographic control data and physical site conditions such as water flow data, and collecting mineral bearing rock seam location data, and overburden stratification and constituency data by surveying the mining property. The surveying of the mining property area is conducted by using survey and photogrammetry techniques, core drilling and testing the mining property to identify overburden characteristics and locations of the mineral bearing rock seams, and identifying and measuring stream and subsurface water flow locations and quantities. The topographic control data is then displayed in the form of a topographic map means such as a cathode ray tube (CRT) or a topographic map. The mineral bearing rock seam data is displayed on the topographic map means. Using the data displayed on the topographic map means, an access road to the mineral bearing rock seam can be located and placed on the map means. Using the data displayed on the topographic map means, environmental control facilities, such as sedimentation control basins and diversion structures, topsoil storage areas; and head of hollow overburden disposal sites are located and placed on the map means. The mining operations are depicted by sequential phases on a series of the topographic map means, each phase being depicted individually on the map means, thereby forming a series of sequential phase map means. The mineral bearing rock from the mineral bearing rock seam is removed to complete the first of the sequential phases of the actual mining operation. The mineral bearing rock is removed from the mineral bearing rock seam of at least one succeeding phase. Preferably, during each succeeding sequential phase, a portion of the property in the preceeding phase is restored. The disturbed portions of the mining property are restored by regrading and revegetating.

The objects and advantages of this invention will be more completely disclosed and described in the following specification, the accompanying drawings, and the appended claims.

BRIEF DESCRIPTION OF THE DRAWINGS

FIG. 2 is inclusive of FIG. 1; FIG. 4 is inclusive of FIG. 3 and precedes FIG. 5, etc. This technique clarifies the operational detail and shows the sequence followed throughout the life of the mine from the beginning of the operation through the completed restoration or reclamation phase. FIGS. 1–8 describe the sequential phases of a multiseam (3) surface mine operation.

Three mineral bearing rock seams are assumed to exist in the entire mining property and are referred to herein as the lower seam 5, middle seam 21 and upper seam 35.

Figure 1:
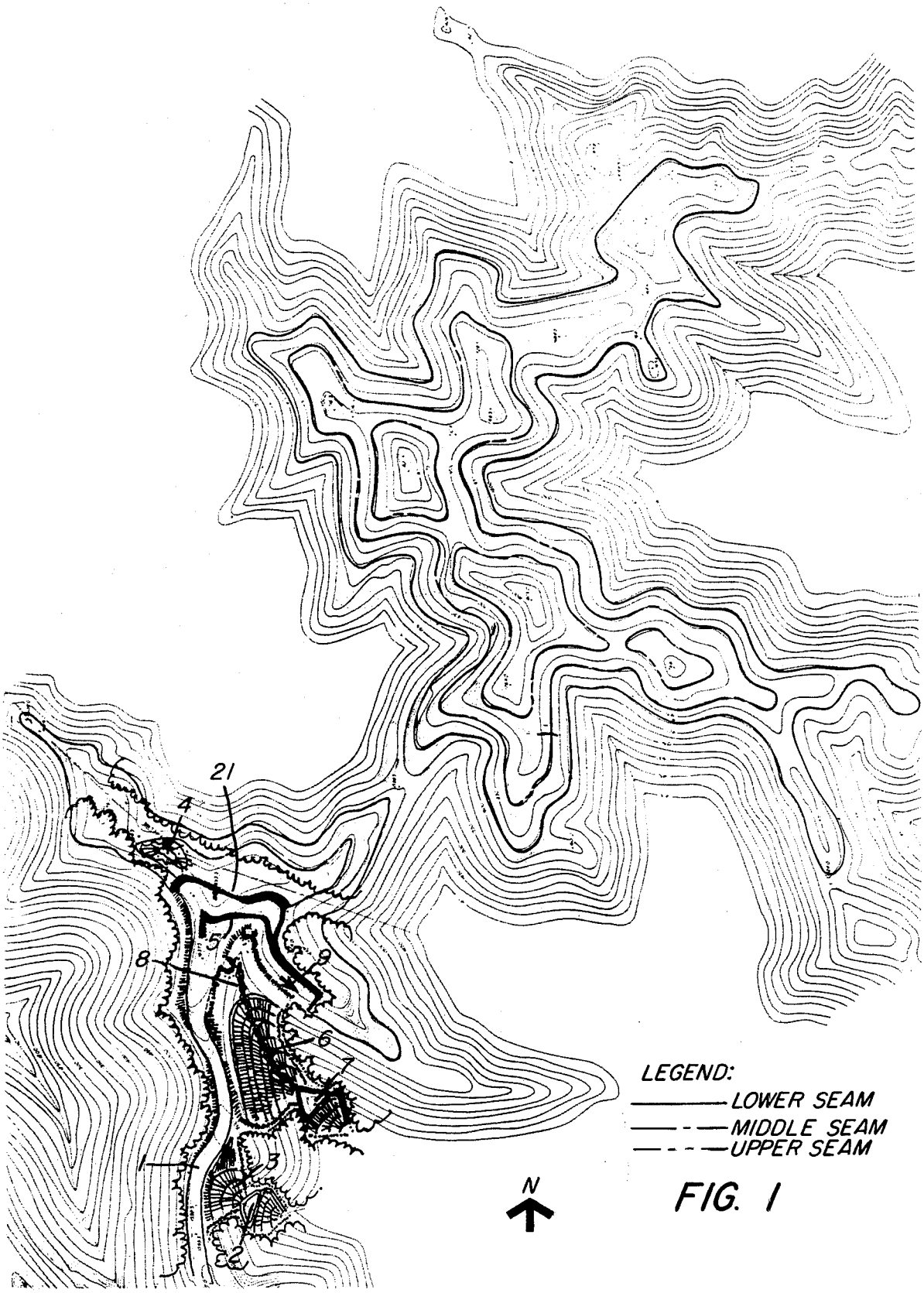
FIGS. 1–8 are plan views of an example of an active surface mining property. They represent the sequential phases of the operation and are cumulative in nature. That is.

FIG. 1 shows the operation of the first mining site at its beginning phase where it has been assumed for purposes of this disclosure that only lower seam 5 and middle seam 21 exist. In order to begin the stripping operation, access to the site is necessary. In order to prepare this initial map, a basic topographic map is prepared by establishing a data base. This data base includes such surveying and aerial photogrammetry as is necessary to establish accurate topographic control in three dimensions. A core drilling and testing program is accomplished to accurately identify the characteristics and location of the mineral bearing rock seam or seams. Identification of the physical locations of outcrop lines as well as the thickness and quality of recoverable material is determined. Data concerning climatological characteristics, stream and subsurface water flow, overburden stratification and constituency is collected. A topographic map is then prepared from the data previously described. It is within the scope of the present invention to employ a computer having a suitable data storage capability and capacity for a topographic display from an output of the computer. Such display can be on the face of a CRT or on a medium defined by well known forms of plotting apparatus. Access to the mining area is selected and located on the topographic map. Thereafter, the environmental control facilities, topsoil storage areas, and head of hollow overburden disposal sites are selected using mining equipment characteristics and the physiographic constraints shown on the topographic map.

As shown in FIG. 1, an access road 1 is located along the ridge top. Material excavated from the access road 1 is deposited in the head of hollow fill area 3 having pond 2 for environmental control. To remain in compliance with numerous safety and environmental regulations, a strict sequence must be adhered to prior to entering any previously-undisturbed area. The sequence is as follows: A sedimentation pond must be constructed downslope to receive runoff water passing through any disturbed area; appropriate diversion ditches and intercept channels are installed; the area to be disturbed is then cleared and grubbed, removing marketable timber, and burning, burying or stockpiling unmarketable timber and debris; topsoil is then removed and stockpiled in a controlled area, seeded and marked; excavation is then completed; and, following completion of final grading, the disturbed area is revegetated. As access road 1 is constructed, the timber is cleared and the topsoil removed and saved by stockpiling in topsoil storage area 4. After access road 1 reaches the mineral bearing rock seam outcrop, in this example, a coal outcrop, the mining of the lower coal seam 5 and middle coal seam 21 begins. As overburden is removed from above lower coal seam 5 and middle coal seam 21, it is deposited in adjacent head of hollow fill area 6 having sedimentation pond 7 and rock core drain 8 for environmental control. In order to provide access to the next mining area, the operation will proceed along lower coal seam 5 and middle coal seam 21 in a direction of arrow 9 to a predetermined termination point. The termination point may be determined by physical, economical, environmental or regulatory limitations. For example, coal seams 5 and 21 may extend to a site designated not to be mined. Mineral bearing rock is removed from the mineral bearing rock seam by well known surface mining equipment such as front end loaders, power shovels and trucks.

Figure 2:
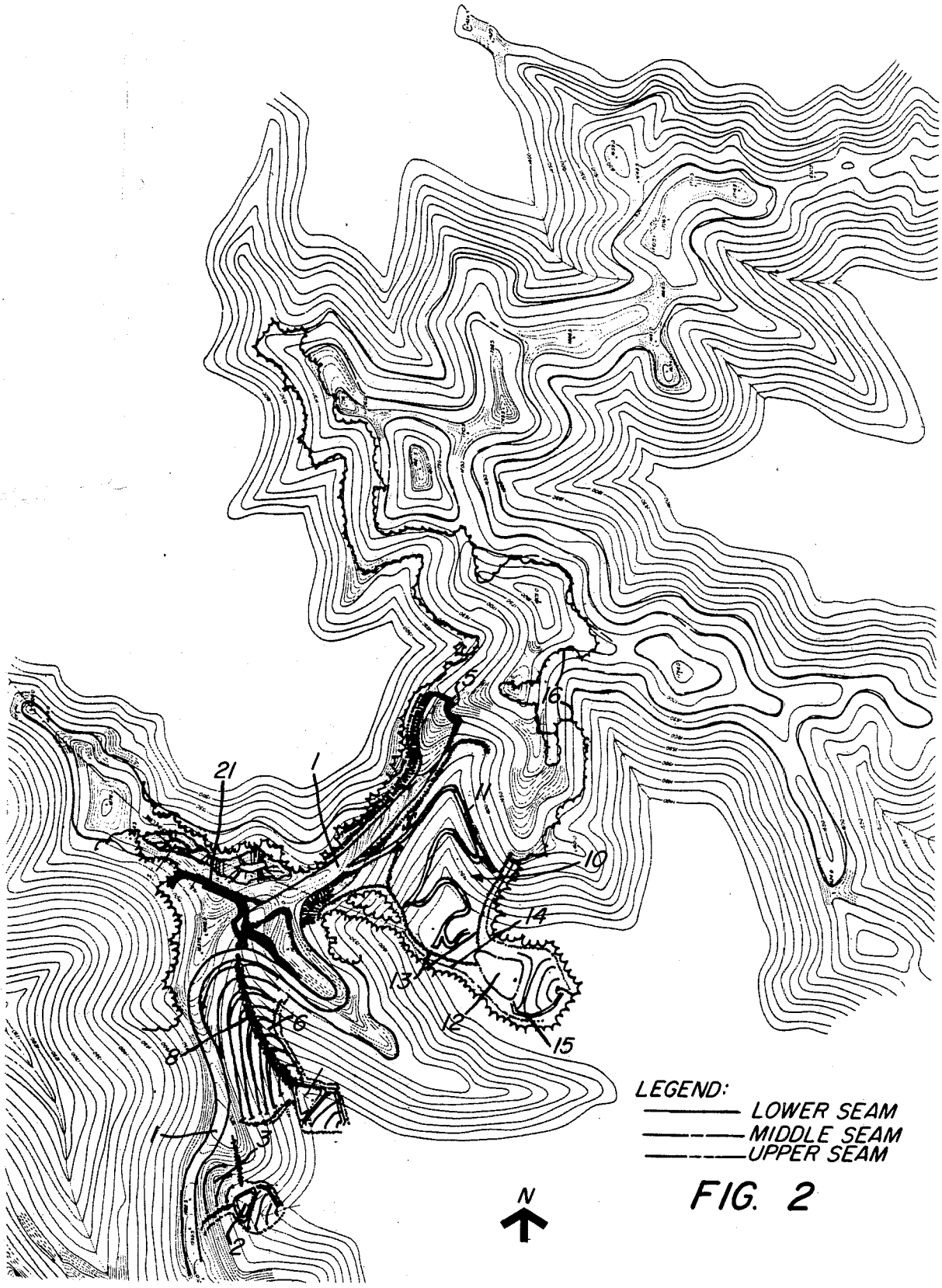

As shown in FIG. 2, access road 1 is constructed around the coal seams 5 and 21 into the next mining area. After the area has been cleared of timber 16 and prior to excavation, topsoil is removed and placed in topsoil storage area 4. In order to provide an area for the excavated overburden material and other head of hollow overburden disposal, site 10 must be prepared. In this example, because of the steepness of the terrain, an access road 11 must be constructed: to remove topsoil that is placed in topsoil storage area 4; to prepare sedimentation pond 12 for environmental control of runoff at the base of the fill area; to install diversion ditches 13 to divert affected water into sedimentation pond 12; to install intercept channels 14 to divert unaffected runoff water away from sedimentation pond 12; to construct an emergency spillway 15 for sedimentation pond 12; and, to provide access for hydroseeding disturbed areas to minimize erosion. Only after all of these items are completed can overburden be deposited in head of hollow fill area 10. This is typical of preparation of head of hollow fill areas throughout the remainder of this example and of other applications of this invention.

As mining begins on the lower coal seam 5 in the second area of mining, the operation proceeds in this example along the outcrop in a northwesterly direction with the overburden being hauled to backfill the first area of mining to improve the alignment of access road 1. As coal is removed, it is hauled off the property via access road 1.

Figure 3:
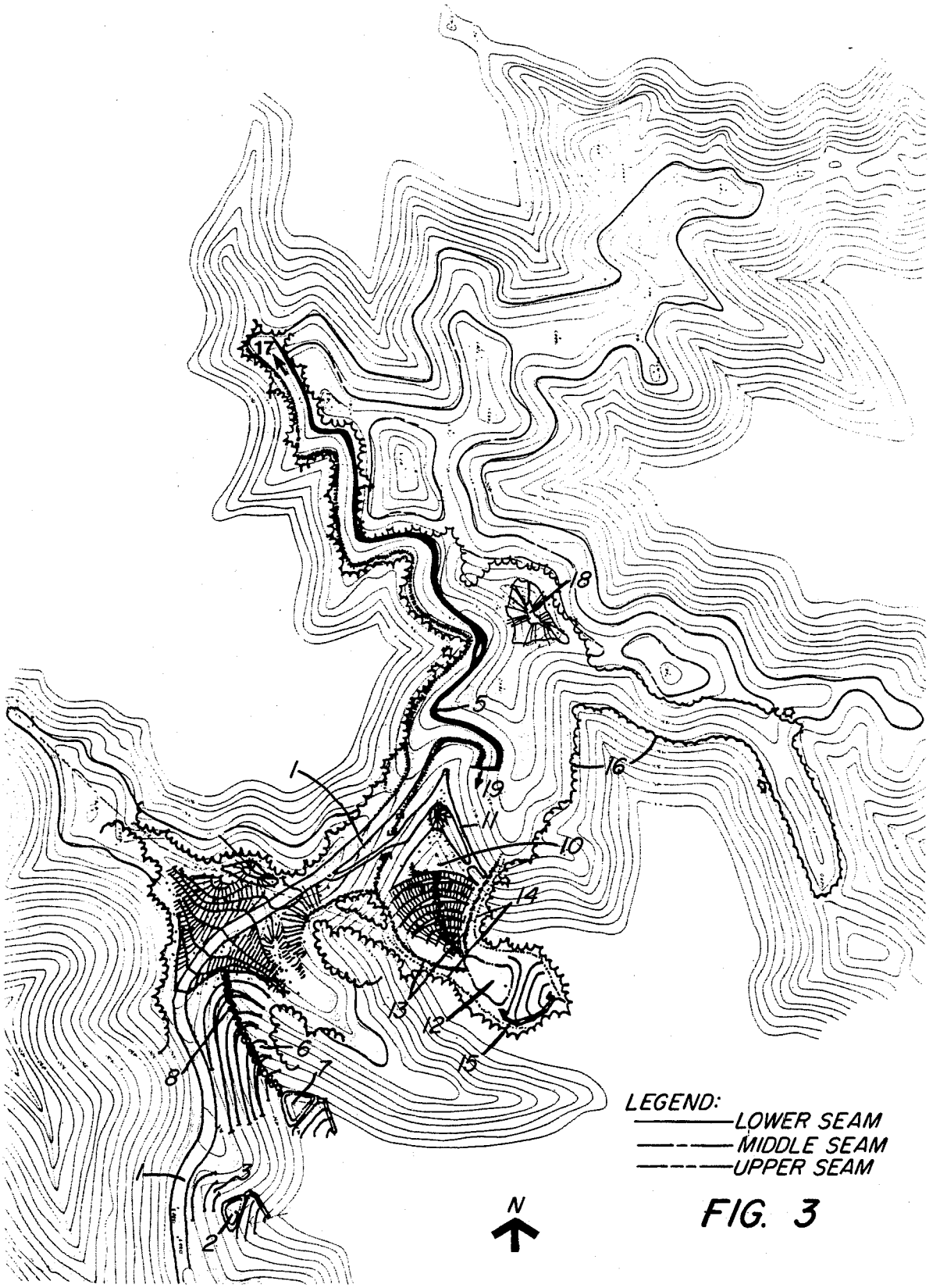

FIG. 3 shows the completed realignment of access road 1 through the first mining area. The backfill has been regraded, topsoil has been replaced from topsoil storage area 4 and the area has been revegetated. The lower bench of the mining operation has been advanced to the northwest in a direction of arrow 17 with overburden being deposited in previously-prepared head of hollow fill area 10. In this example, the exposed highwall will be horizontally augered upon completion of each cut. This process is typical for exposed highwalls of the entire lower coal seam 5. All topsoil removed prior to excavation of overburden is placed into newly-established topsoil storage area 18. When the mining operation advancing in a northwesterly direction 17 reaches the limit of the coal outcrop in this direction or other constraint as previously described, the operation in this direction stops and begins to proceed in a southernly direction 19 along lower coal seam 5. The overburden material taken from this advancing highwall is also placed in head of hollow fill 10. Affected water resulting from the mining operation will be handled in the pit areas and pumped into natural drainage ways after retention and/or treatment, making sure that all waters discharged will be in compliance with applicable water effluent regulations.

Figure 4:
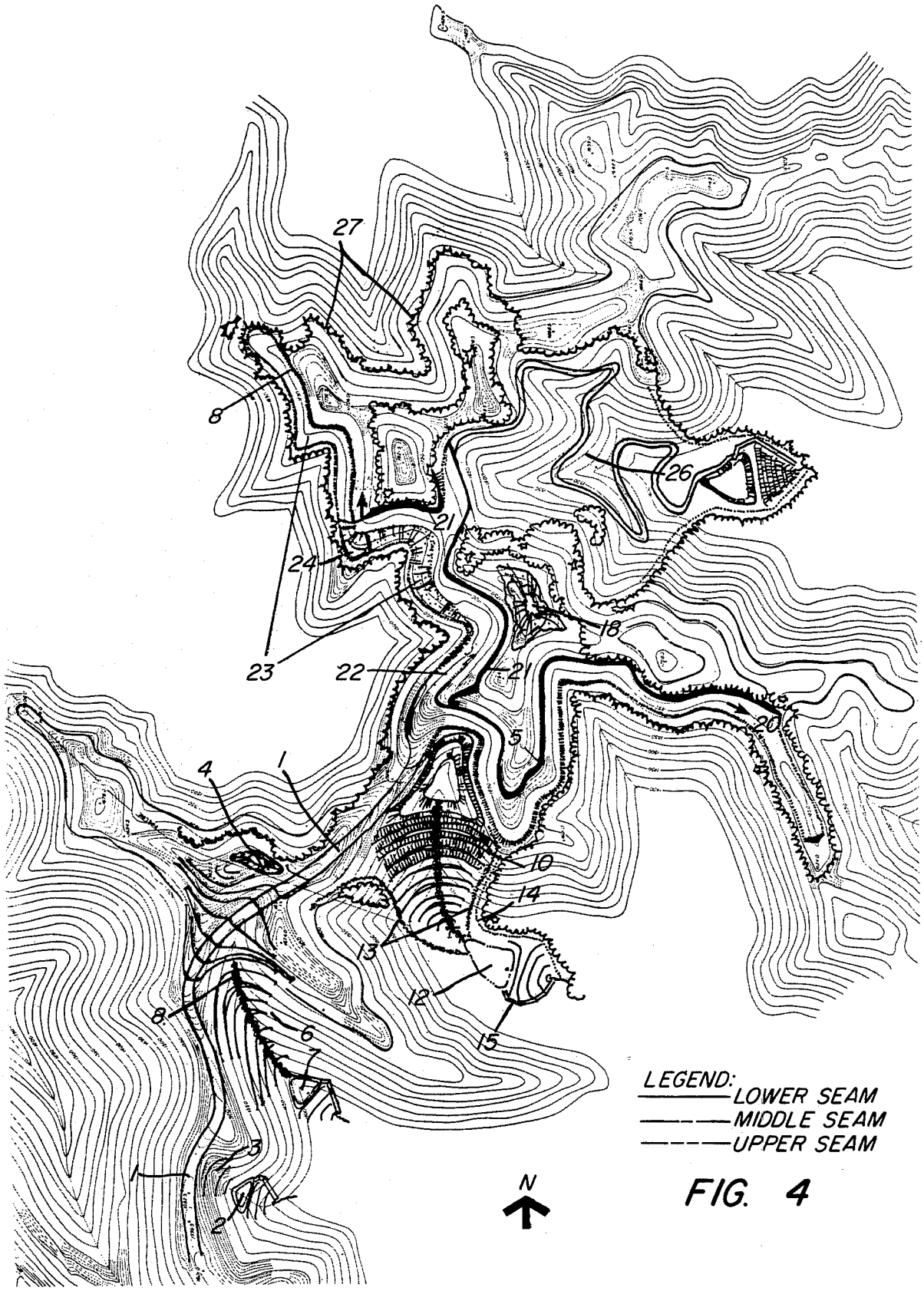

FIG. 4 shows the completion of head of hollow fill area 10 with the remainder of the overburden material taken from the highwall advanced along the lower seam 5 in an easterly direction 20 followed by augering of the lower seam if desired as described previously. Topsoil removed from this area is taken to topsoil storage area 18. At this point, the middle coal seam 21, the coal seam immediately above lower coal seam 5, begins to be worked. Access road 1 is extended to the vicinity of middle coal seam 21 by ramp 22. Overburden material from middle coal 21 is deposited over the lower coal seam 5 highwall and into pit 23. The spoil area is graded and topsoil is replaced from topsoil storage area 18. Finally, the area is revegetated. Runoff from the reclaimed area is directed in sedimentation ponds 24 until sufficient revegetation allows waters to be discharged in compliance with water effluent requirements. This procedure is typical for runoff from all reclaimed and revegetated areas. The middle coal seam 21 cut is advanced to the north-northwest 25 with continual placement of overburden into pit 23.

During this time, the next head of hollow fill area 26 is prepared. All steps taken in the preparation of head of hollow fill area 10 are repeated. Timber clearing 27 for the next cut on lower coal seam 5 is also completed.

Figure 5:
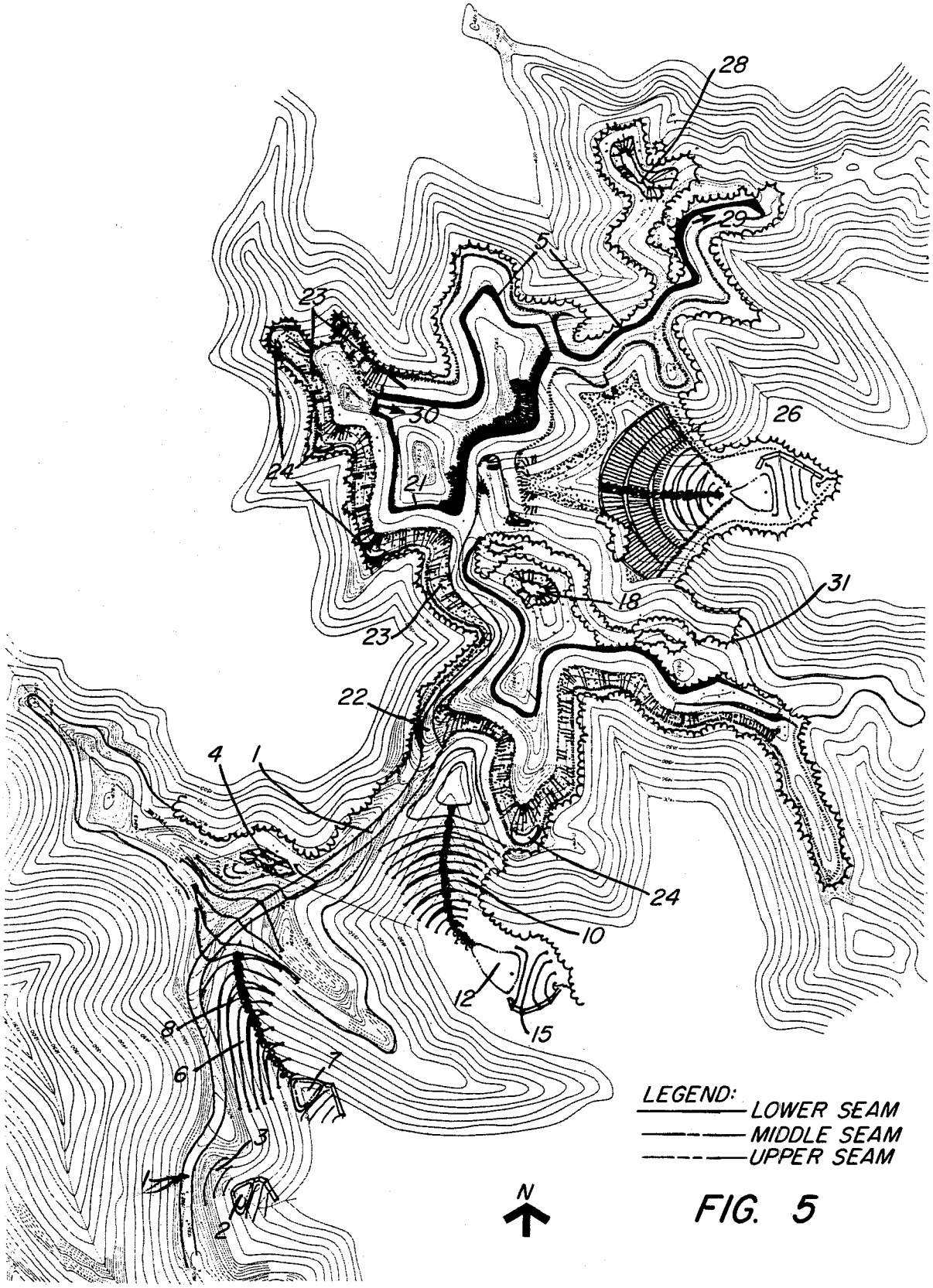

FIG. 5 shows a newly-prepared topsoil storage area 28 to be used for topsoil from the advancing cuts to the north. Lower coal seam 5 is advanced in a northerly direction 29 with overburden material being placed in prepared head of hollow fill area 26. Auger mining can be carried out to remove additional coal as described previously. Upon completion of mining the lower coal seam 5 in the northernmost mining site, the middle coal seam 21 highwall will advance in an easterly direction 30 with the overburden being placed in the pit 23, then graded and reclaimed. Timber clearing 31 is completed in anticipation of the next cut on lower seam 5.

Figure 6:
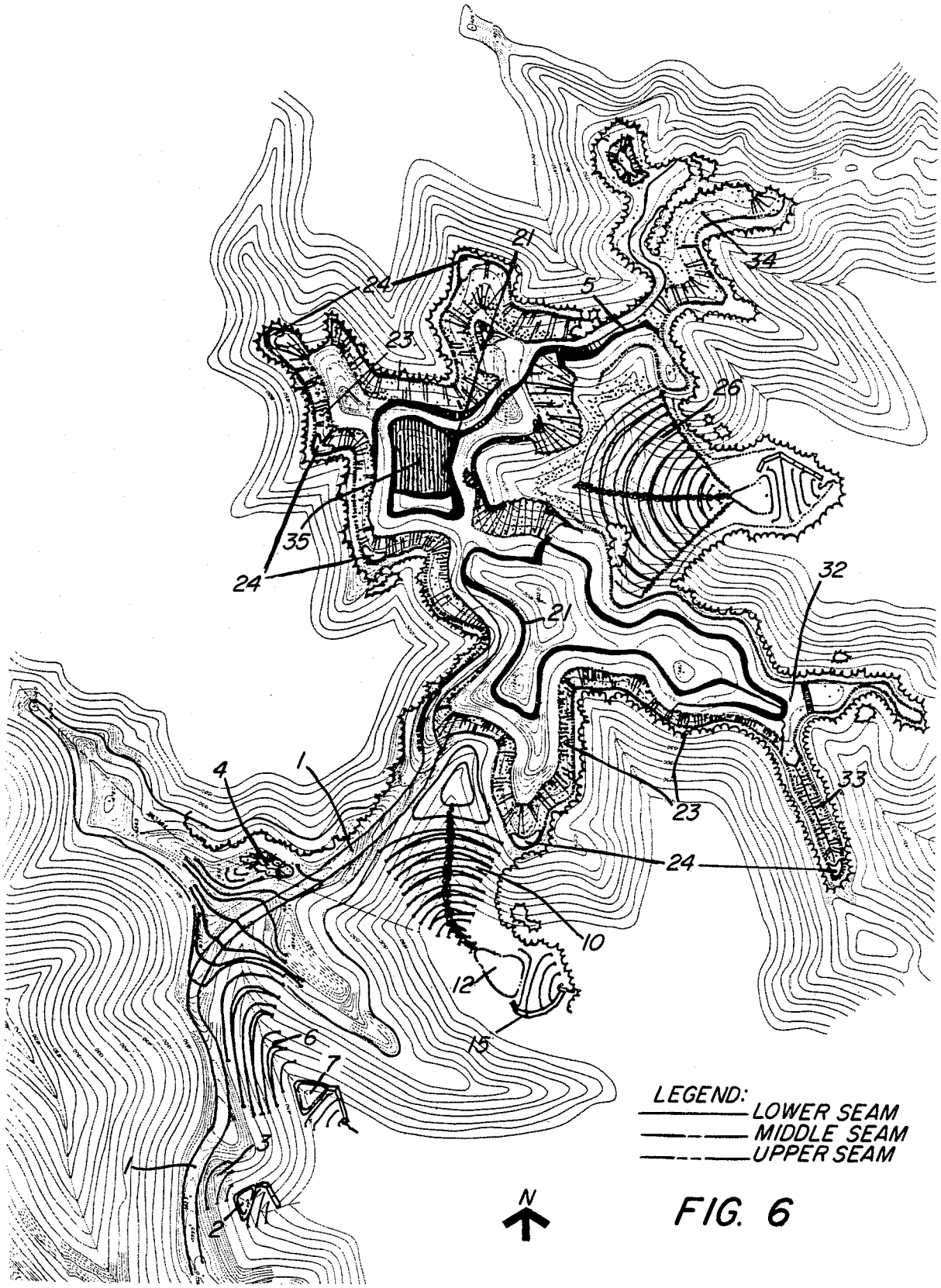

FIG. 6 shows the removal of the remaining coal from lower coal seam 5 in eastern area 32. The overburden is deposited in head of hollow fill 26 and southeasternmost point 33. Location 33 is backfilled and reclaimed as overburden is removed from eastern area 32. As mining in lower coal seam 5 nears completion in the easterly direction, middle coal seam 21 begins to be worked with overburden being placed into pit 23 then regraded and revegetated. Auger mining continues to occur in those areas of lower coal seam 5 where desired as previously described.

As illustrated in FIG. 6, reclamation of the northernmost mining area 34 is accomplished with overburden removed to uncover middle coal seam 21 in the northernmost area and from overburden removed to expose upper coal seam 35.

Figure 7:
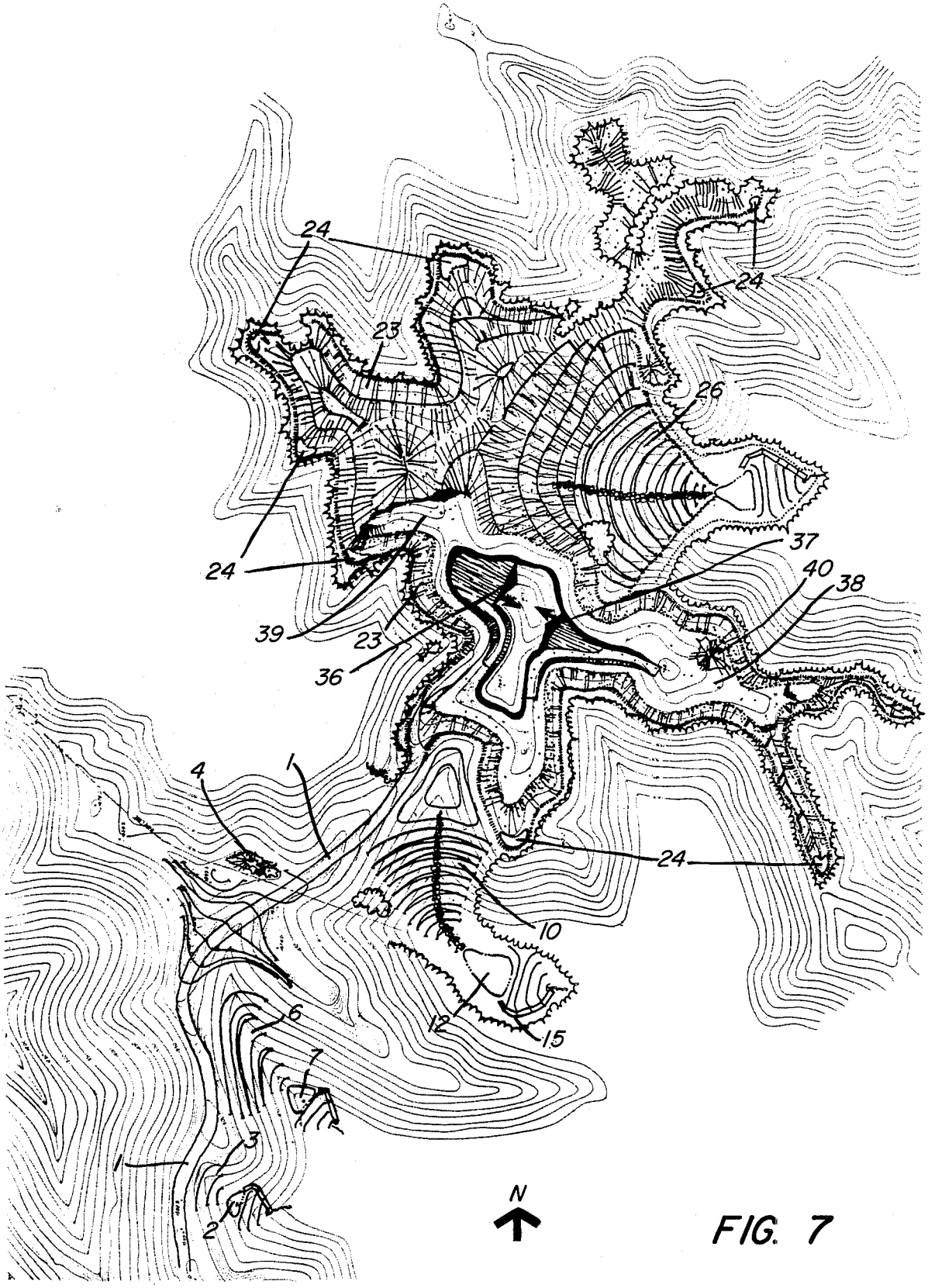

FIG. 7 shows the northernmost portion of the property nearing completion of mining and reclamation. The head of hollow fill area 26 is also completed and reclaimed. At this point, the upper coal seam highwalls 36 and 37 are being worked towards each other with overburden being used to backfill areas 38 and 39 before being reclaimed and revegetated. Temporary topsoil storage area 40 for topsoil removed from the cap is created in the most convenient position for immediate use in reclamation.

Figure 8:
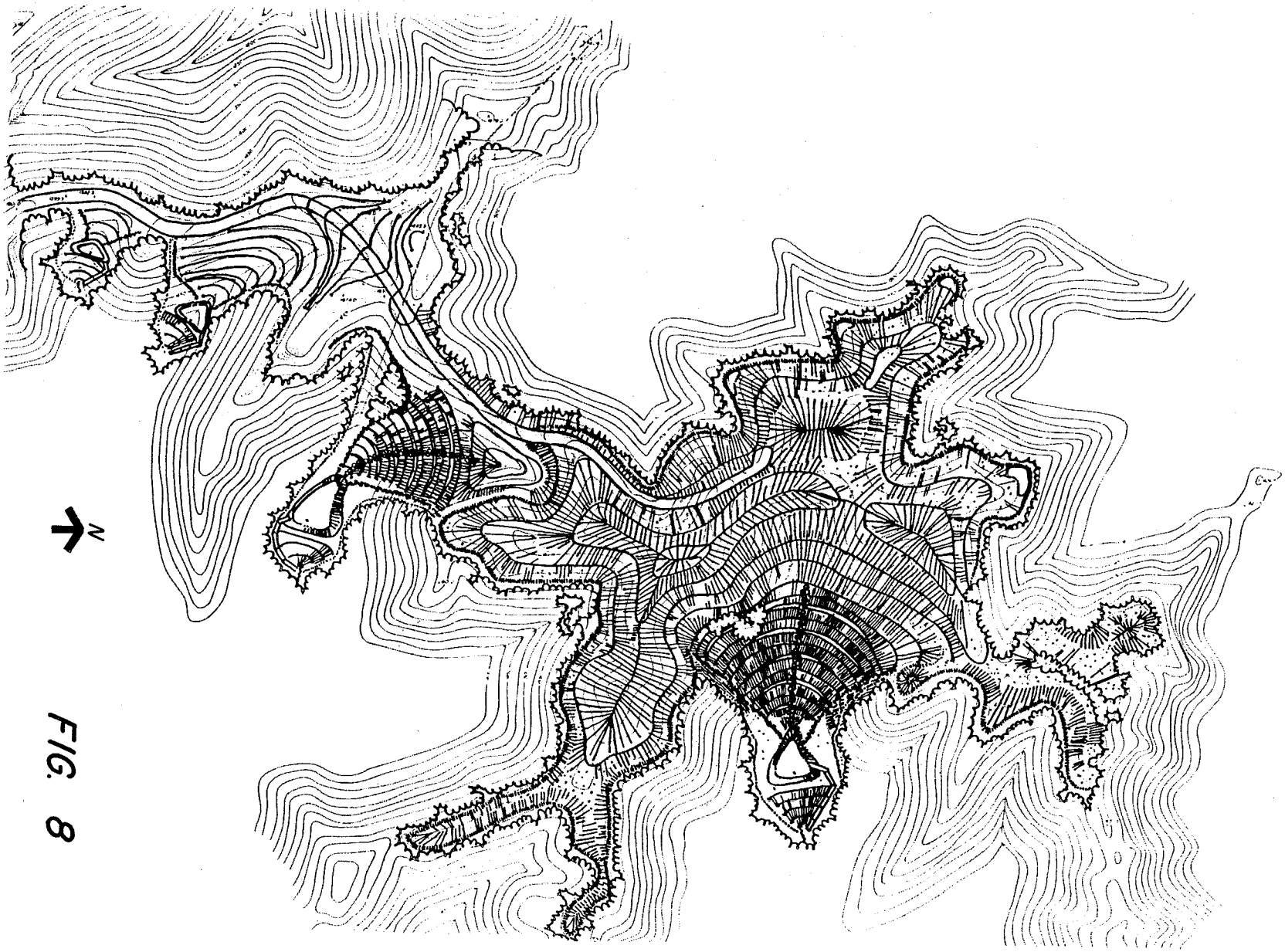

FIG. 8 shows the mining property following final grading and prior to complete revegetation. As the final area of mining is completed and properly regraded, the remaining topsoil in the topsoil areas 4 are exhausted to complete the reclamation. In view of the foregoing, it will now be apparent to those skilled in the art that the preparation of a topographic map may be carried out, when desired, by depicting data exemplified by FIG. 1, preparing copies for a record and/or use, and then adding to the same map additional data as depicted in FIG. 2. Copies of the map will again be produced for a record and/or use. This process can be continued in the same manner for depicting all data on one map for mining the property.

This novel method of mining is not limited to only coal mining. Limestone, graphite and clays as well as any bedded mineral bearing rock which are capable of being recovered by surface mining can be mined using this novel method. For the purposes of disclosing this invention, coal is defined as a composite of carbonaceous minerals.

Although the invention has been shown in connection with certain embodiments, it will be readily apparent to those skilled in the art that various changes in form and method steps can be made to suit requirements without departing from the spirit and scope of the invention.

We claim:

1. A method of developing, mining and restoring mining property having at least one mineral bearing rock seam which comprises:

(a) collecting three-dimensional topographic control data and physical site conditions, such as water flow data;

(b) collecting mineral bearing rock seam location data and overburden stratification and constituency data;

(c) displaying said topographic control data in the form of a topographic map;

(d) displaying said mineral bearing rock seam data on the said topographic map;

(e) establishing an access road to said mineral bearing rock seam by using the data displayed on said topographic map by said steps of collecting;

(f) establishing environmental control facilities, topsoil storage areas and head of hollow overburden disposal sites by using the data displayed on said topographic map by said steps of collecting;

(g) producing a series of topographic map means using said topographic map to depict mining operations by sequential phases such that an initial mining operation is depicted on a first of said series of topographic map means development, succeeding mining and restoring operations are each depicted on others of said topographic map means;

(h) removing mineral bearing rock from said mineral bearing rock seam to complete the first of said sequential phases of the actual mining operation;

(i) completing a succeeding sequential phase of removing mineral bearing rock from said mineral bearing rock seam; and (j) restoring the disturbed portions of the mining property.

2. A method of developing, mining and restoring mining property, as recited in claim 1, wherein said step (a) includes:

surveying said mining property;

photographing said mining property using photogrammetry techniques; and identifying and measuring said water flow locations, quantities and qualities.

3. A method of developing, mining and restoring mining property, as recited in claim 1, wherein said step (b) includes core drilling and testing said mining property to identify overburden characteristics and locations of said mineral bearing rock seams to be mined.

4. A method of developing, mining and restoring mining property, as recited in claim 1, wherein said environmental control facilities include sedimentation control basins and diversion structures and said mineral bearing rock seam is coal.

5. A method of developing, mining and restoring mining property, as recited in claim 1, wherein said step (i) includes completing at least three succeeding sequential phases of removing mineral bearing rock from said mineral bearing rock seam.

6. A method of developing, mining and restoring mining property, as recited in claim 1, wherein said step (e) is further defined to include locating the access road on the map.

7. A method of developing, mining and restoring mining property, as recited in claim 1, wherein said step (e) is further defined to include establishing said access road to the mineral bearing rock seam on said mining property.

8. A method of developing, mining and restoring mining property, as recited in claim 1, wherein said step (f) is further defined to include displaying said environmental control facilities, said topsoil storage areas and said head of hollow overburden disposal sites on said map.

9. A method of developing, mining and restoring mining property, as recited in claim 1, wherein said step (f) is further defined to include establishing said environmental control facilities, said topsoil storage areas and said head of hollow overburden disposal sites on said mining property.

10. A method of developing, mining and restoring mining property, as recited in claim 1, wherein said map means includes display on the face of a cathode ray tube.

11. A method of developing, mining and restoring mining property, as recited in claim 1, wherein said step (g) is further defined to include depicting on one of said topographic map means previous and succeeding mining operations.

* * * * *